US007287721B2

(12) United States Patent
Quick et al.

(10) Patent No.: US 7,287,721 B2
(45) Date of Patent: Oct. 30, 2007

(54) WINDING TUBE

(75) Inventors: Dieter Quick, Lindlar (DE); Bernd Rost, Much (DE)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 11/286,509

(22) Filed: Nov. 23, 2005

(65) Prior Publication Data

US 2006/0102774 A1 May 18, 2006

Related U.S. Application Data

(63) Continuation of application No. PCT/EP2004/005611, filed on May 25, 2004.

(30) Foreign Application Priority Data

May 27, 2003 (DE) ..... 103 24 356

(51) Int. Cl.
*B65H 26/00* (2006.01)

(52) U.S. Cl. ..... 242/912

(58) Field of Classification Search ..... 242/912
See application file for complete search history.

(56) References Cited

U.S. PATENT DOCUMENTS 5,755,519 A * 5/1998 Klinefelter ..... 400/249
6,152,625 A * 11/2000 Oliverio ..... 400/247
6,334,587 B1 * 1/2002 Roder ..... 242/563
6,786,660 B1 * 9/2004 Woosley et al. ..... 400/244
6,814,329 B2 * 11/2004 Ebisawa et al. ..... 242/523
7,018,118 B1 * 3/2006 Woosley et al. ..... 400/242
2003/0189125 A1 * 10/2003 Trierenberg ..... 242/563
2004/0056141 A1 3/2004 Quick
2005/0237200 A1 * 10/2005 Bellum et al. ..... 340/572.8

FOREIGN PATENT DOCUMENTS

CH 400 708 10/1965
EP 311940 A1 * 4/1989
EP 597184 A1 * 5/1994
EP 1 160 189 3/2001
WO 94/28531 12/1994
WO 98/28213 7/1998

* cited by examiner

*Primary Examiner*—Gene O. Crawford
*Assistant Examiner*—Sang Kim
(74) *Attorney, Agent, or Firm*—DLA Piper US LLP

(57) ABSTRACT

A winding tube is provided for a web-shaped semi-finished product or finished product. The tube comprises a cylindrical, elongated tube body having an inner wall. A data carrier that can be read in a contactless manner and that contains data about the web-shaped semi-finished product or finished product is secured to the tube body by means of a tubular holding element, positioned within the tube body. The data carrier is held in the interior of the tube body spaced from the inner wall.

19 Claims, 5 Drawing Sheets

Fig. 4a
Fig. 4b
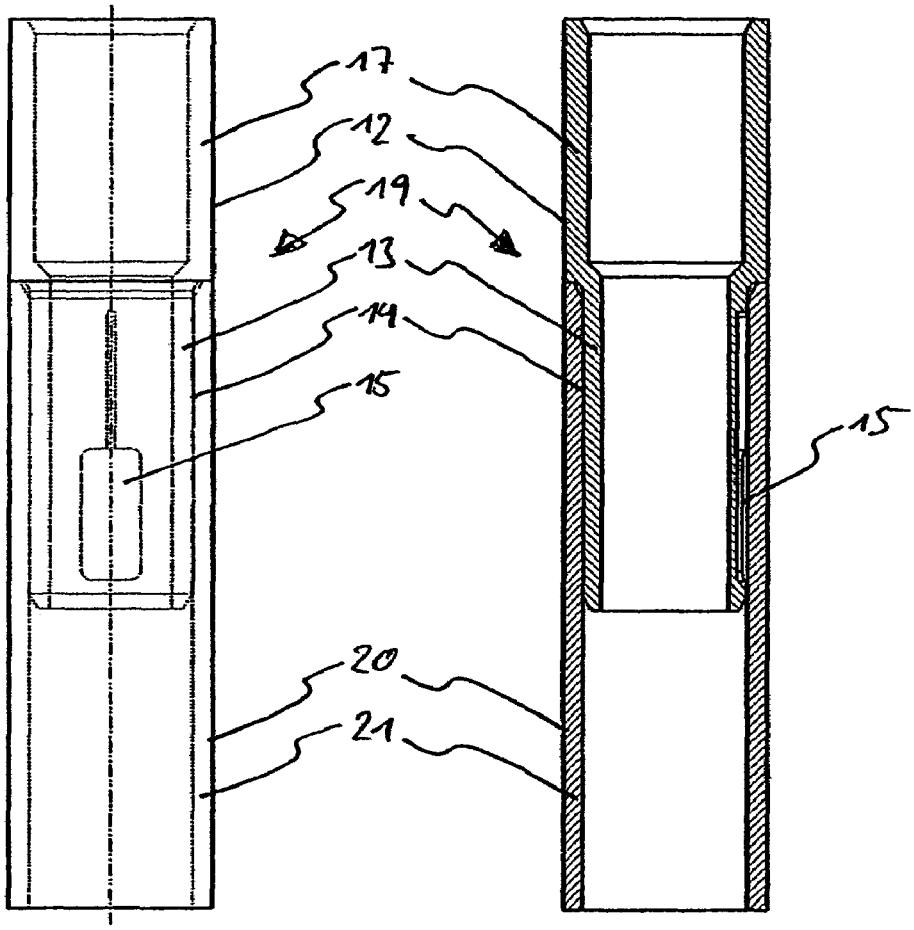
Fig. 4c
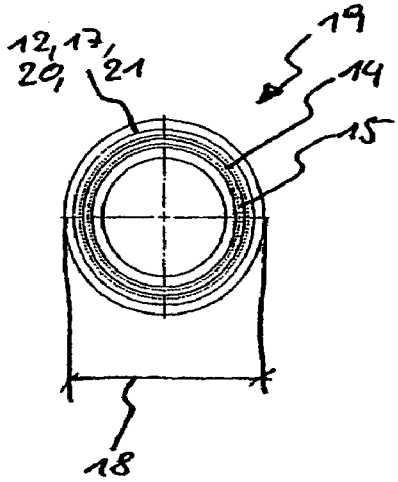

WINDING TUBE

RELATED APPLICATION

This is a continuation of International Application No. PCT/EP2004/005611 filed May 25, 2004. This international application is herein incorporated by reference.

BACKGROUND OF THE INVENTION

Web-shaped semi-finished products or finished products with web widths of up to several meters are generally known in many forms within the framework of industrial manufacturing processes and are preferably made available for processing in windings with diameters of up to several meters. Substantially flexible semi-finished products or finished products are wound onto winding tubes that impart the required stability required for the industrial processing, especially on the one hand at the start of the winding on and on the other hand toward the end of the winding off, even given only a few layers of the semi-finished product or finished product. For example, papers for the industrial printing of newspapers and books, cellulose webs for manufacturing hygienic cloths and cleaning cloths as well as the endless plurality of foils [sheets], textile fabrics and knit fabrics are made available for further processing as web-shaped semi-finished products or finished products on such winding tubes.

The plurality of such web-shaped semi-finished products or finished products whose differences in a manufacturing process are frequently present only in the area of nuances makes a reliable identification of a special web-shaped semi-finished product or finished product difficult. For example, not only papers with different gram weights but also with different surface qualities, color shades or additives can be used for the printing of books, but in addition, the processing of different batches of the same paper in a product should be avoided as a rule.

In order to solve this problem in the manufacturing of cigarette papers and filter papers, DE 202 05 555 U1 suggests integrating a data carrier in the wall of the winding tube which data carrier contains data about the winding tube and about the web-shaped semi-finished product or finished product, which data should be able to be read from the chip in a contactless manner. Such data carriers and the methods for reading and writing are generally known in the form of radio frequency transponder elements (so-called RFID tags).

The known winding tubes are often heavily loaded mechanically during the winding on and winding off of the web-shaped semi-finished product or finished product and are therefore subjected to relatively high wear. The data carrier integrated directly into the winding tube cannot be separated, even from a worn winding tube, with economically justifiable expense for reuse and may hinder the recycling of the winding tube itself.

The data carrier integrated into the known winding tubes is exposed substantially to the same mechanical deformations as the adjacent winding tube. Both a radial compression [buckling] of the winding tube by the wound-on web-shaped semi-finished product or finished product as well as the dynamically oscillating deformation of the winding tube in particular toward the end of the winding off are directly transferred onto the data carrier. This loading may result in a high number of rejections of the data carriers.

The methods used to produce the known winding tubes with data carriers offer no possibility of retrofitting present winding tubes, of removing a data carrier from the winding tube or of replacing one data carrier by another one. The plurality of the possible requirements placed on winding tubes and data carriers for different usages or in different methods therefore requires in principle a data carrier that can be used for all conceivable uses and is therefore very valuable. In particular, when data carriers are desired and should be readable and writable from a fairly remote distance, data carriers with active transmitting apparatuses are necessary that as a rule have their own energy supply. In this instance the required structural space may be large and the expense high so that a recycling of the data carriers is appropriate.

In the known winding tubes, the data carriers are inserted into a hollow space adapted to their shape. This hollow space represents a mechanically weak point of the divided winding tube and a preferred breaking point, especially given a high loading of the winding tube with oscillations. In order to avoid material failure, the known winding tubes provided with data carriers must be manufactured from relatively high-quality materials or with relatively thick walls.

DE 101 15 200 A1 teaches a spool for receiving or transporting wound material. The known spool comprises a data carrier from which information about the spool and/or the wound material can be gathered. The data carrier is designed as a transponder and can be arranged at various positions on the spool. For one, it can be fastened to the inner spool wall. Alternatively, its attachment to a hub-shaped flange part separately attached to the spool body on a conical outer surface of this flange is disclosed. Moreover, an arrangement on the inner side of a radially running front surface of the tube is also suggested.

WO 98/28213 A1 describes a web storage roll, e.g. for paper webs, with an interactively codable and readable information carrier designed as a code carrier comprising a data memory. The code carrier can be arranged, e.g., centrally in a hub that can be inserted into a tube body or it can be adhered to the inside of the tube body wall. However, it can also be arranged alternatively inside the tube body wall in the form of an axially running bore on the front side or inside a bore that radially penetrates the wall.

Furthermore, WO 99/50788 A1 also discloses a winding tube that is provided on its inner jacket surface with a flexible carrier element consisting of paper whose surface facing the inner jacket surface is provided with an adhesive coating. An electronic data carrier is adhered to the carrier element by this adhesive coating. The adhesive coating also serves to adhere the carrier element including the data carrier to the inner jacket surface of the tube body in order to establish a firm connection between winding tube and data carrier. The data carrier, for its part, serves to be able to query information about the winding tube or the winding material from the outside in a contactless manner. Alternatively, the data carrier can also be adhered from the outside to the outer jacket surface of the tube body by the same carrier element, which, however, results in unevenness in the area of the tube diameter, viewed over the tube circumference. Finally, the data carrier can also be fastened in the tube by a tubular object, which tubular object corresponds in its diameter substantially to the inside diameter of the tube.

The invention is based on the problem of suggesting a winding tube with data carrier which winding tube is economical to manufacture and can be used in a variable manner, exhibits good operating and recycling properties and thus avoids the described disadvantages of the known state of the art.

SUMMARY OF THE INVENTION

The invention relates to a winding tube on which a web-shaped semi-finished product or finished product is received. The tube comprises a cylindrical, elongated tube body with an inner wall. A data carrier, that can be read in a contactless manner and that contains data about the web-shaped semi-finished product or finished product and/or other data, is held in the interior of the tube body by a tube-shaped holding element. Preferably, the tubular holding element in which the data carrier is connected to the tube body, retains the data carrier in a spaced relationship with respect to the inner wall of the tube body. Using a separate holding element, the data carrier may be decoupled in the manufacture and use of the winding tube to the extent that a destruction-free disassembly of even large data carriers becomes possible.

Mechanical loads of the tube body do not act directly on the data carrier and the attaching of the data carrier requires no weakening of the material of the tube body. Depending on the application, a data carrier can be inserted into a winding tube during use or removed at the end of the useful life the tube body. Thus, the holding element can be re-used or used independently of the original tube.

In one aspect of the invention, the data carrier is connected to the holding element in such a manner that it is spaced from the inner wall of the tube body. The data carrier is then mechanically decoupled as well as possible from the tube body and its deformation during operation. In order to reliably maintain this spacing, an intermediate layer consisting, e.g., of a foamed material can be introduced between the data carrier and the wall of the tube body. If the data carrier is adhered, for example, to the tube body, no intermediate layer is necessary.

The data carrier is preferably connected to the holding element. For example, the data carrier can be fixed to an outer surface of the holding element by an adhesive strip or a tube of heat-shrinkable material. If the holding element is manufactured in the injection molding method, the data carrier may also be positioned in the mold and the plastic injected over the carrier.

The integrating of the data carrier with the holding element reduces the number of individual structural components and simplifies the manipulation of the winding tube of the invention. Furthermore, no special receiving element adapted to the data carrier is typically necessary.

In another aspect of the invention, the data carrier can be inserted in a trough in the outer jacket surface of the holding element. The holding element can then be used with minimal expense with various data carriers (that fit into the trough).

The winding tube in accordance with the invention preferably comprises a cylindrical adapter consisting of plastic that is received in the tube body on its end and by means of which the winding tube can be held firmly on the winding device, relative to the rotation about a longitudinal axis of the tube body, which holding element is connected to the adapter. The integration of the holding element into the adapter reduces the number of structural components and thus simplifies the manipulation of the winding tube.

A radiofrequency transponder element, a so-called "RFID tag" is preferably used as data carrier in the winding tube of the invention. These generally known data carriers are commercially available in many designs for varied requirements and are economical mass-produced products. Moreover, since these data carriers do not typically require their own voltage supply, the size of the holding element can be minimized.

Alternatively, other data carriers, e.g., actively transmitting modules, can be used in a winding tube of the invention. Such a design can be used if a device for reading out from or writing to the data carrier cannot be or should not be approached up to a few centimeters from the data carrier, as is required for using an RFID tag, when using the winding tube of the invention.

It is preferable if data contained on the data carrier of a winding tube of the invention can be changed in a contactless manner. Data can be stored in a manner that describes the current state of the web-shaped material or contains information about the current state of processing, e.g., the length of the web-shaped semi-finished product or finished product in a winding. Even the storage of the codes of the machines successively used for processing the winding, of the beginning time and end time of the particular processing as well as storage areas used for process documentation and quality assurance is conceivable. Alternatively, data carriers can also be used data, e.g., the product batch of the web-shaped material, can only be read out during operation.

BRIEF DESCRIPTION OF THE DRAWINGS

The present invention is explained in the following using two exemplary embodiments.

FIG. 4*a* shows a lateral view of a second winding tube in accordance with the invention with the second holding element.

FIG. 4*b* shows a longitudinal section of the second winding tube.

FIG. 4*c* shows a front view of the second winding tube.

DETAILED DESCRIPTION OF THE DRAWINGS

Figure 1:
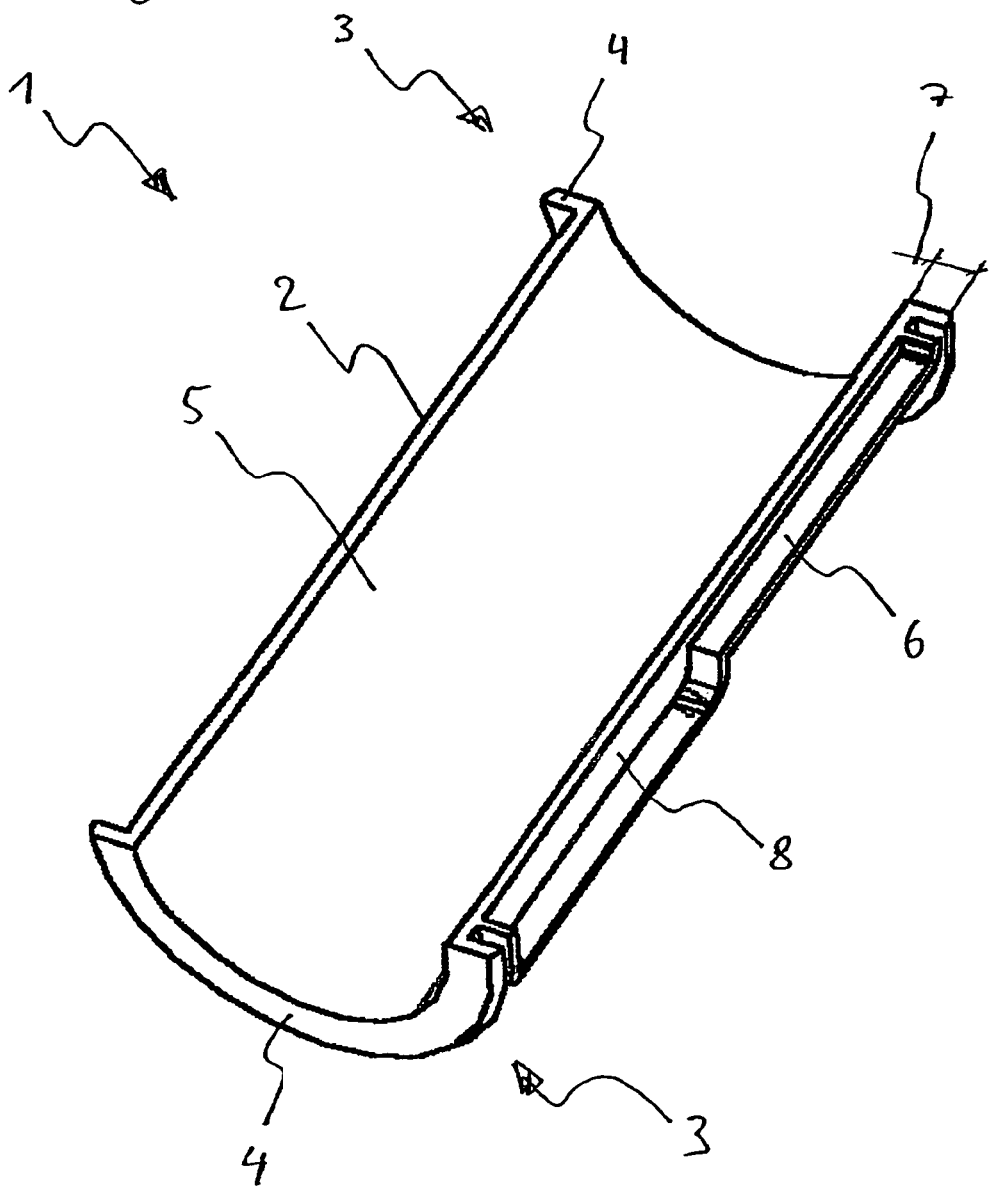
FIG. 1 shows a perspective sectional view of a first holding element in accordance with the invention.

FIG. 1 shows tubular holding element 1 manufactured from plastic, preferably by an injection molding method. Holding element 1 consists of cylindrical, elongated insertion tube 2 comprising a radially projecting flange or collar 4 on both ends 3. Web 6 is attached to outer jacket surface 5 of holding element 1, has the same height 7 as collar 4 and completely surrounds scoop-shaped trough 8. Alternatively, collar 4 can also be provided with a plurality of radially running slots that increase elasticity and ensure a reliable fixing or clamping even considering deviations in the dimensions and shape of the inside diameter of the tube. It is also possible for winding tube 9 shown in FIGS. 2*a* to 2*c* to be provided with two adapters arranged on either or both ends, in addition to the central holding element. It is contemplated that the adapters can be removed from tube body 10 without being destroyed. The adapter may be provided on a tube body 10 manufactured from material that is qualitatively of lesser value and therefore more economical or on a tube that can be heavily loaded and consist of high-quality [high-grade] plastic. On the other hand, the standardized measures for the inside and outside diameters of the winding tube can be maintained with the aid of adapters and at the same time the winding body can have a reduced inside diameter, which makes its manufacture from plastic much more economical.

Figure 2A:
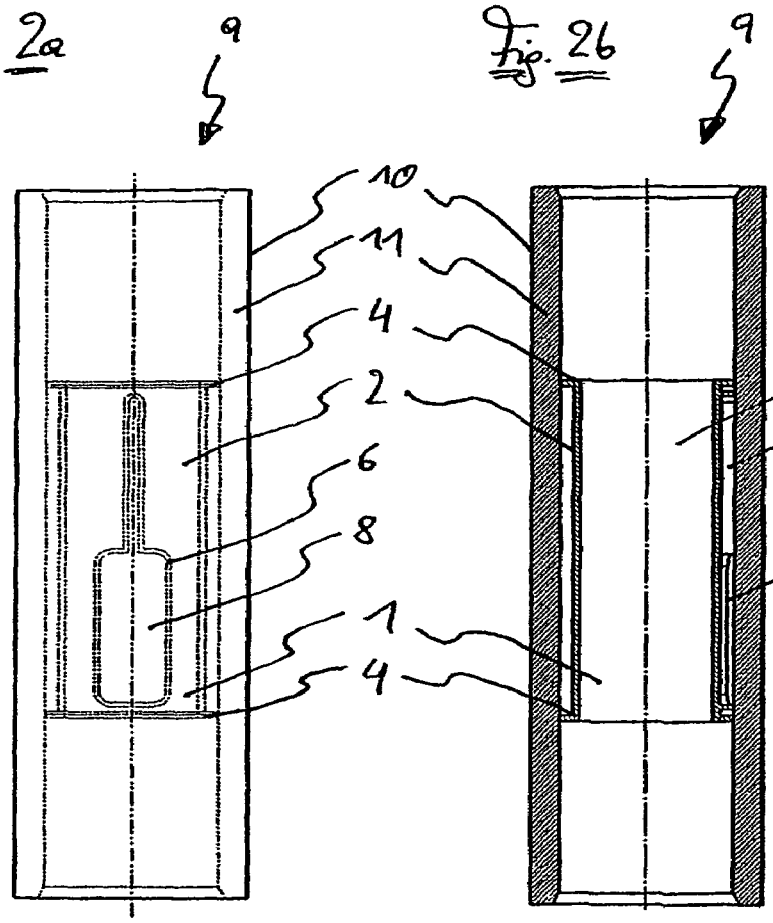
FIG. 2*a* shows a lateral view of a first winding tube in accordance with the invention with the first holding element.
Figure 2B:
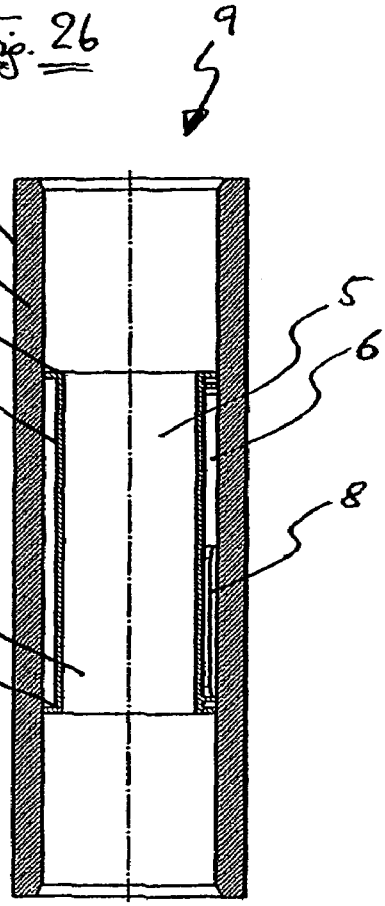
FIG. 2*b* shows a longitudinal section of the first winding tube.
Figure 2C:
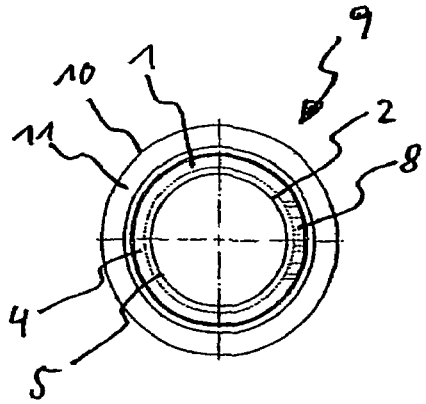
FIG. 2*c* shows a front view of the first winding tube.

FIGS. 2*a*, 2*b* and 2*c* show three views of a winding tube 9 with cylindrical, elongated tube body 10 in which a data carrier (not shown) is held by holding element 1 in accordance with FIG. 1. The data carrier is a radio frequency transponder element (RFID tag) adhered in trough 8 with hot adhesive or a casting resin. The holding element 1 is held tightly against inner wall of 11 of tube body 10 by means of collars 4 and web 6. As illustrated, the data carrier does not make contact with tube body 10.

Figure 3:
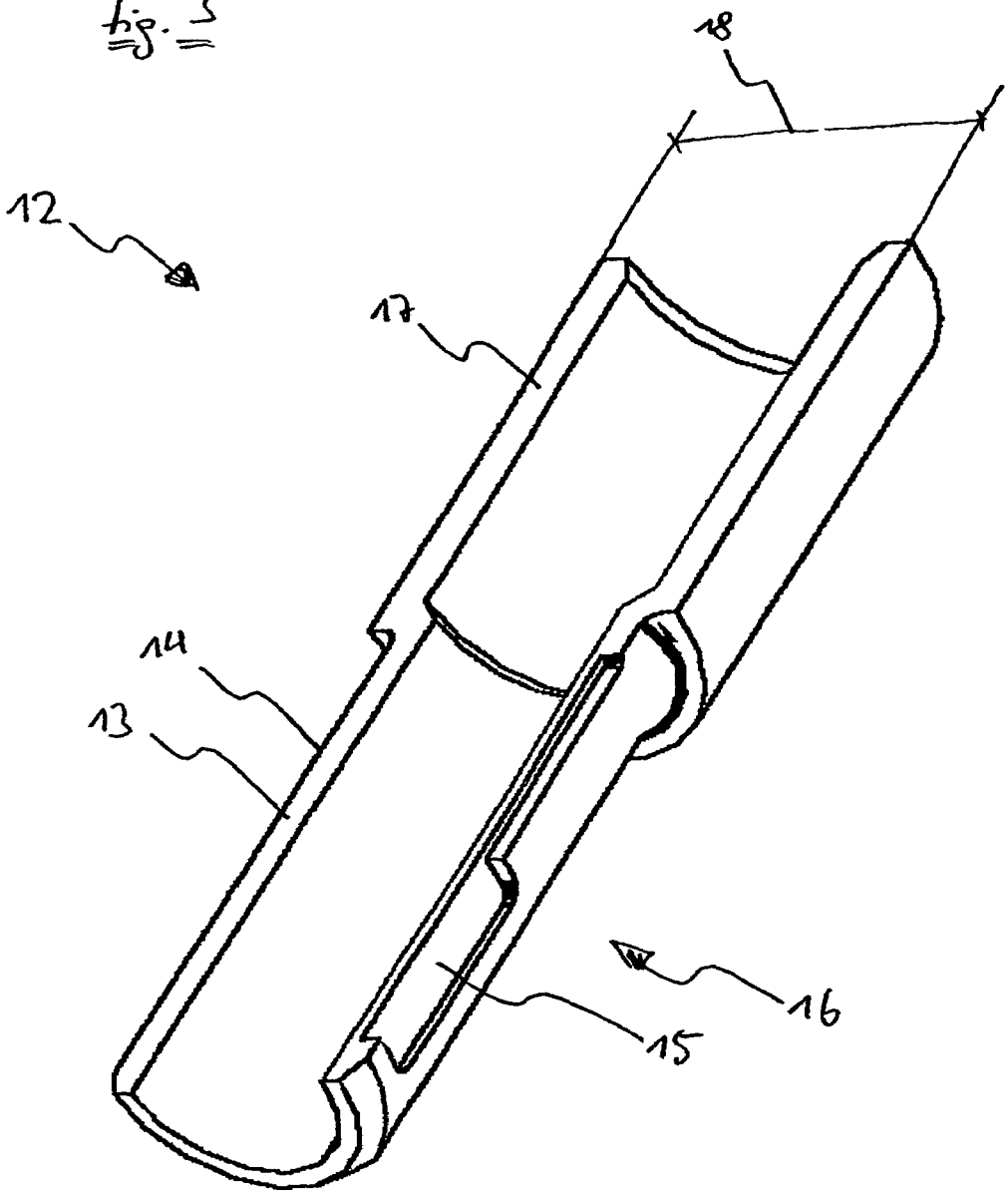
FIG. 3 shows a perspective sectional view of an adapter with a second holding element in accordance with the invention.

FIG. 3 shows adapter 12 manufactured from plastic by an injection-molding method. Adapter 12 comprises a cylindrical, elongated insertion tube 13 and a scoop-shaped trough 15 which is formed in the outer surface 14 of the tube. Insertion tube 13 and trough 15 form holding element 16. Insertion tube 13 is followed by clamping tube 17 that is also cylindrical and elongated and whose outer diameter 18 is greater than insertion tube 13.

FIGS. 4*a*, 4*b* and 4*c* show three views of a second winding tube embodiment 19 having a tube body 20 that is cylindrical and elongated (shown as truncated in length). The tube body retains a data carrier (not shown) within a holding element 16 formed on adapter 12 in accordance with FIG. 3. Adapter 12 is received on the end in tube body 20 and is held tightly, with jacket surface 14 of holding element 16 on inner wall 21 of tube body 20.

Figure 5B:
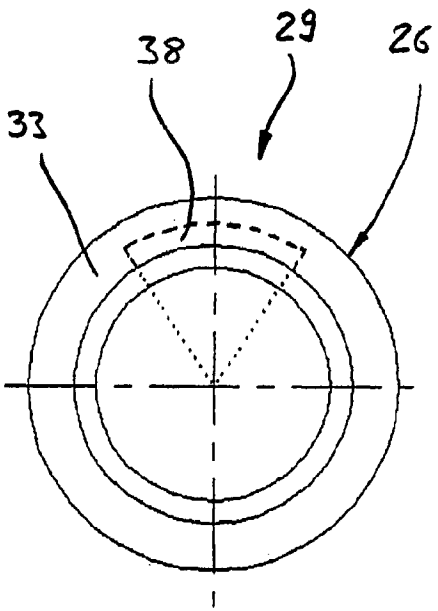
FIG. 5*b* shows a front view of the winding tube according to FIG. 5*a*.
Figure 5A:
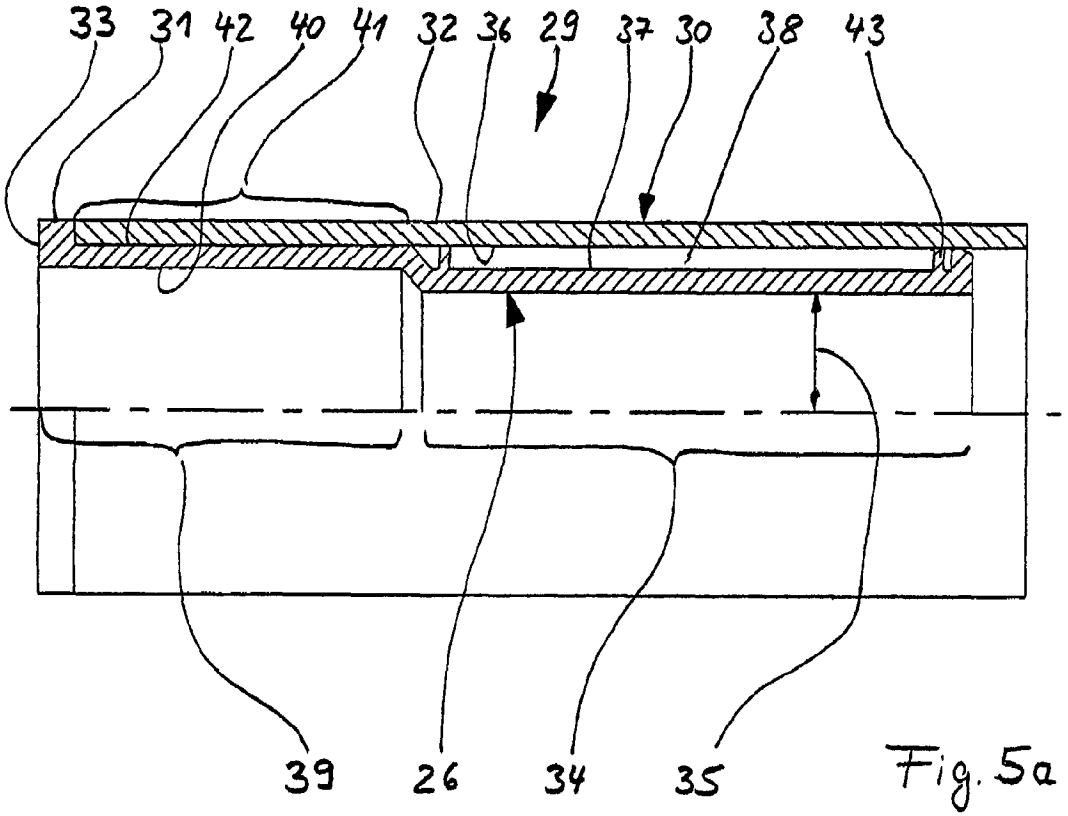
FIG. 5*a* shows a partial longitudinal section through another winding tube.

In winding tube 29 shown in FIG. 5*a* in a longitudinal section holding element 26 projects on the front side over outer jacket surface 32 of tube body 30 by a small length 31. Here, holding element 26 assumes the function of a tensioning or clamping adapter, such as described, e.g., in international patent application WO 03/031305 A1, in addition to the function of holding and fixing the data carrier (not shown).

Holding element 26 comprises holding area 34 on its side facing away from front side 33 in which the holding area inside radius 35 is reduced. Receiving chamber 38 for the data carrier is located between inside jacket surface 36 of winding body 30 and outside jacket surface 37 of holding element 26 in the holding area 34. As follows, e.g., from the front view according to FIG. 5*b*, the receiving chamber 38 is a trough in holding area 34 and extends over an angular range of approximately 70° and for the width of chamber 38, measured in the circumferential direction. Preferably, the chamber is adapted to be the same size as the data carrier.

Furthermore, holding element 26 also has tensioning area 39 which, as shown in the exemplary embodiment of WO 03/031305 A1, can be provided on its inside jacket surface 40 with, e.g., three trapezoidal cams staggered by 120° relative to each other and running in the axial direction. The cams form a positive or torque-locking connection between the clamping jaws of a winding device and winding tube 29.

Furthermore, holding element 26 also comprises connecting area 41 in which it is coupled in a torque-locking manner to tube body 30. This coupling takes place with the aid of corresponding coggings on inside jacket surface 36 of tube body 30 and of outside jacket 42 of holding element 26 in connecting area 41. A reliable transmission of torque from the winding device into winding tube 29 and from there via friction also onto the web-shaped winding material is ensured in this manner. Receiving chamber 38 is limited on its ends by web-shaped circumferential collar 43. Receiving chamber 38 preferably has a length of approximately 100 mm in the axial direction and a width of approximately 25 mm measured in the circumferential direction and a depth of approximately 5 mm measured in the radial direction. Tube body 30 can have different lengths and is provided on both ends with holding element 26.

The invention claimed is:

1. A winding tube on which a web-shaped semi-finished product or finished product can be received, the tube comprising:

a cylindrical, elongated tube body having an inner wall, a data carrier that can be read in a contactless manner and that contains data about the web-shaped semi-finished product or finished product;

a cylindrical adapter received in the tube body on one end for holding the winding tube on a winding device; and a tubular holding element connected to the adapter and positioned within and engaging the inner wall of the tube body, the data carrier held entirely within the interior of the tube body, adjacent the inner wall, by the tubular holding element.

2. The winding tube according to claim 1, wherein the adapter is made of plastic.

3. The winding tube according to claim 1, wherein the data carrier is a radio frequency transponder element.

4. The winding tube according to claim 1, wherein data contained on the data carrier can be changed in a contactless manner.

5. The winding tube according to claim 4, wherein the changeable data describes the current state of the web-shaped material.

6. The winding tube according to claim 1, wherein the holding element is locked in a connecting area of the tube body to the inner wall of the tube body.

7. The winding tube according to claim 1, wherein the data carrier is spaced from the inner wall of the winding tube.

8. The winding tube according to claim 1, wherein the data carrier is secured to the adapter by an adhesive or by a casting resin.

9. The winding tube according to claim 1, wherein the data carrier is held within a trough defined on an outer surface of the holding element.

10. An adapter for a winding tube, the winding tube being structured to receive a web-shaped semi-finished or finished product thereon, and having a cylindrical, elongated tube body having an inner wall, the adapter comprising:

a tubular holding element structured to fit within the tube and to abut the inner wall of the tube, thereby retaining the tubular holding element within the tube;

a clamping tube structured to be received by a chuck of a winding device; and a data carrier that can be read in a contactless manner and that contains data about the web-shaped semi-finished product or finished product, the entire data carrier retained within the tube body and adjacent the inner wall of the tube and the tubular holding element.

11. The adapter according to claim 10, wherein the adapter is made of plastic.

12. The adapter according to claim 10, wherein the data carrier is a radio frequency transponder element.

13. The adapter according to claim 10, wherein data contained on the data carrier can be changed in a contactless manner.

14. The adapter according to claim 13, wherein the changeable data describes the current state of the web-shaped material.

15. The adapter according to claim 10, wherein the holding element is locked in a connecting area of the tube body to the inner wall of the tube body.

16. The adapter according to claim 10, wherein the data carrier is spaced from the inner wall of the winding tube.

17. The adapter according to claim 10, wherein the data carrier is secured to the adapter by an adhesive or by a casting resin.

18. The adapter according to claim 10, wherein the data carrier is held within a trough defined on an outer surface of the holding element.

19. An adapter for a winding tube, the winding tube structured to receive windings of a web-shaped semi-finished or finished product thereon and having a cylindrical, elongated, hollow tubular body and an inner wall, the adapter comprising:

a tubular holding element structured to securely fit within the tubular body and to abut the inner wall thereof for retaining the tubular holding element in a fixed position within the tube;

a clamping tube structured to be received by a chuck of a winding device, the clamping tube integrally formed with the holding element and positioned at one end thereof; and a single data carrier adapted to be read in a contactless manner and to contain data about the product, the data carrier retained by the holding element in a position juxtaposed to the inner wall;

the data carrier secured by the holding element to prevent rotational movement relative to the inner wall of the tube during winding of the tube.

* * * * *